US007931160B2

(12) United States Patent
Newbouild et al.

(10) Patent No.: US 7,931,160 B2
(45) Date of Patent: Apr. 26, 2011

(54) VERTICALLY MOUNTED SHELF ASSEMBLY AND ACCESSORIES THEREFOR

(75) Inventors: Peter J. Newbouild, Milan (IT); Pasquale Cirulli, Milan (IT); Craig Thompson, Inver Grove Heights, MN (US); James L. Bries, Cottage Grove, MN (US); Russell G. Pihlstrom, Blaine, MN (US); Jon E. Stickrod, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 387 days.

(21) Appl. No.: 11/849,394

(22) Filed: Sep. 4, 2007

(65) Prior Publication Data

US 2008/0053935 A1 Mar. 6, 2008

Related U.S. Application Data

(60) Provisional application No. 60/842,623, filed on Sep. 6, 2006.

(51) Int. Cl.
*A47F 5/08* (2006.01)

(52) U.S. Cl. ..... 211/90.02; 211/119.009

(58) Field of Classification Search ..... 211/90.2, 211/87.01, 90.01, 90.04, 95, 103, 107, 119.003, 211/119.009, 189, 190, 175, 207, 208, 113, 211/126.5, 126.1; 248/121, 242, 243; D6/531, D6/549; 108/1, 2, 4, 5, 6, 8

See application file for complete search history.

(56) References Cited

U.S. PATENT DOCUMENTS

| | | | | | |
|---|---|---|---|---|---|
| 625,271 | A | * | 5/1899 | Lang | 211/85.13 |
| 1,554,137 | A | * | 9/1925 | Slifkin | 108/6 |
| 1,561,432 | A | * | 11/1925 | Hitchcock | 248/230.2 |
| 2,963,170 | A | * | 12/1960 | Lori | 108/8 |
| 3,921,539 | A | * | 11/1975 | Berger | 108/8 |
| 4,024,312 | A | | 5/1977 | Korpman | |
| 4,106,736 | A | | 8/1978 | Becker | |
| 4,108,314 | A | | 8/1978 | Racca | |
| 4,203,373 | A | * | 5/1980 | Conti | 108/152 |
| 4,310,193 | A | * | 1/1982 | Kolleas | 296/75 |
| 4,969,580 | A | | 11/1990 | Mikhail | |
| 5,255,401 | A | | 10/1993 | Sambrookes et al. | |
| 5,288,046 | A | * | 2/1994 | Eklof et al. | 248/220.21 |
| 5,289,927 | A | | 3/1994 | Emery | |
| 5,433,152 | A | | 7/1995 | Henry | |
| 5,507,464 | A | * | 4/1996 | Hamerski et al. | 248/683 |

(Continued)

FOREIGN PATENT DOCUMENTS

DE 33 31 016 C2 7/1992

(Continued)

OTHER PUBLICATIONS

Search Report, Singapore Patent Application No. 200901480-4 (PCTUS2007/077571), Aug. 19, 2010, 5 pages.

*Primary Examiner* — Darnell M Jayne
*Assistant Examiner* — Stanton L Krycinski
(74) *Attorney, Agent, or Firm* — Kenneth B. Wood

(57) ABSTRACT

A wall mountable shelf assembly includes an elongated support rail, at least one accessory slidably connected with the support rail, and at least one stretch releasing adhesive strip arranged between the support rail and the wall for securing the shelf assembly to the wall.

14 Claims, 2 Drawing Sheets

U.S. PATENT DOCUMENTS

| | | | | |
|---|---|---|---|---|
| 5,516,581 | A | 5/1996 | Kreckel et al. | |
| 5,934,636 | A * | 8/1999 | Cyrell | 248/246 |
| D421,692 | S * | 3/2000 | Wojtowicz et al. | D6/525 |
| 6,231,962 | B1 | 5/2001 | Bries et al. | |
| 6,477,966 | B1 * | 11/2002 | Petryna | 108/11 |
| 6,520,351 | B1 | 2/2003 | Zadro | |
| 6,541,089 | B1 | 4/2003 | Hamerski et al. | |
| 6,569,521 | B1 | 5/2003 | Sheridan et al. | |
| 6,591,996 | B1 * | 7/2003 | Wu | 211/90.02 |
| 6,641,910 | B1 | 11/2003 | Bries et al. | |
| 6,688,238 | B1 * | 2/2004 | Alexiou | 108/42 |
| 6,972,141 | B1 | 12/2005 | Bries et al. | |
| 7,000,265 | B2 * | 2/2006 | Faisst | 4/570 |
| 7,078,093 | B2 | 7/2006 | Sheridan et al. | |
| 7,540,456 | B2 * | 6/2009 | Thompson | 248/205.3 |
| 2004/0026426 | A1 * | 2/2004 | Rutherford et al. | 220/480 |
| 2004/0172748 | A1 | 9/2004 | Faisst | |
| 2008/0000859 | A1 * | 1/2008 | Yang et al. | 211/90.02 |

FOREIGN PATENT DOCUMENTS

| | | |
|---|---|---|
| DE | 19650000 A1 | 6/1998 |
| FR | 2549361 | 1/1985 |
| KR | 2002-0025782 | 6/2001 |

* cited by examiner

VERTICALLY MOUNTED SHELF ASSEMBLY AND ACCESSORIES THEREFOR

CROSS REFERENCE TO RELATED APPLICATION

This application claims the benefit of U.S. Provisional Patent Application No. 60/842,623, filed Sep. 6, 2006, the disclosure of which is incorporated by reference herein in its entirety.

TECHNICAL FIELD

The present invention relates generally to storage articles and, more particularly, to a storage shelf assembly that can be adhesively mounted to, for example, the interior surface of a bath or shower enclosure to hold a variety of items used in the bath or shower.

BACKGROUND

Shower and bath storage devices, often referred to as shower or bath caddies, are commonly used to hold and/or store items such as soap, shampoo, and other bath items in shower and bath enclosures. Because of the weight of the stored items and because it is generally not practical to mount such items in shower or bath enclosures using mechanical fasteners, such as nails and screws, such devices are typically hung from the shower nozzle fixture. Such devices are known in the prior art. U.S. Pat. No. 4,969,580 (Mikhail Essatt), U.S. Pat. No. 4,108,314 (Racca), U.S. Pat. No. 5,255,401 (Sambrookes et al.), and U.S. Pat. No. 6,520,351 (Zadro), for example, disclose such devices. It is also known to mount such devices using suction cups as disclosed in, for example, U.S. Pat. No. 5,289,927 (Emery).

Such devices, however, suffer from certain drawbacks and shortcomings. Devices that hang from the shower nozzle fixture, for example, tend to be large and cumbersome and because such devices must hang down from the shower nozzle fixture below the shower head so the items in the caddy can be accessed by a user, they are unstable and tend to swing sideways or slide off of the shower nozzle fixture. In addition, the mounting location is limited by the location of the shower nozzle fixture such that they cannot be moved, and, because they must be mounted immediately below the shower head, they tend to interfere with the use of the shower. Devices mounted with suction cups, on the other hand, have limited holding capacity and tend to lose their holding ability over time. As a result, devices mounted with suction cups frequently fail, thereby causing the device and its contents to fall off the wall. The need therefore exists for a storage device that can be adhesively mounted to the wall surface of a shower or bath enclosure that is inexpensive, easy to install, is adjustable, and holds strongly enough to support items commonly stored in such devices.

The need therefore exists for a storage device that can be adhesively mounted to the wall surface of a shower or bath enclosure that is inexpensive, easy to install, is adjustable, and hold strongly enough to support items commonly stored in such devices.

SUMMARY

The invention overcomes the above-identified limitations in the field by providing a shelving system that can be adhesively mounted to, for example, the wall surface of a shower or bath enclosure, that is inexpensive, easy to install, and holds strongly enough to support items commonly stored in such devices.

In one embodiment, the present invention provides a wall mountable shelf assembly including an elongated support rail that is mounted vertically on a wall surface, at least one accessory movably connected with the support rail, and at least one stretch releasing adhesive strip arranged between the support rail and the wall for securing the shelf assembly to the wall.

BRIEF DESCRIPTION OF DRAWINGS

The present invention will be further described with reference to the accompanying drawings, in which.

DETAILED DESCRIPTION

Figure 1:
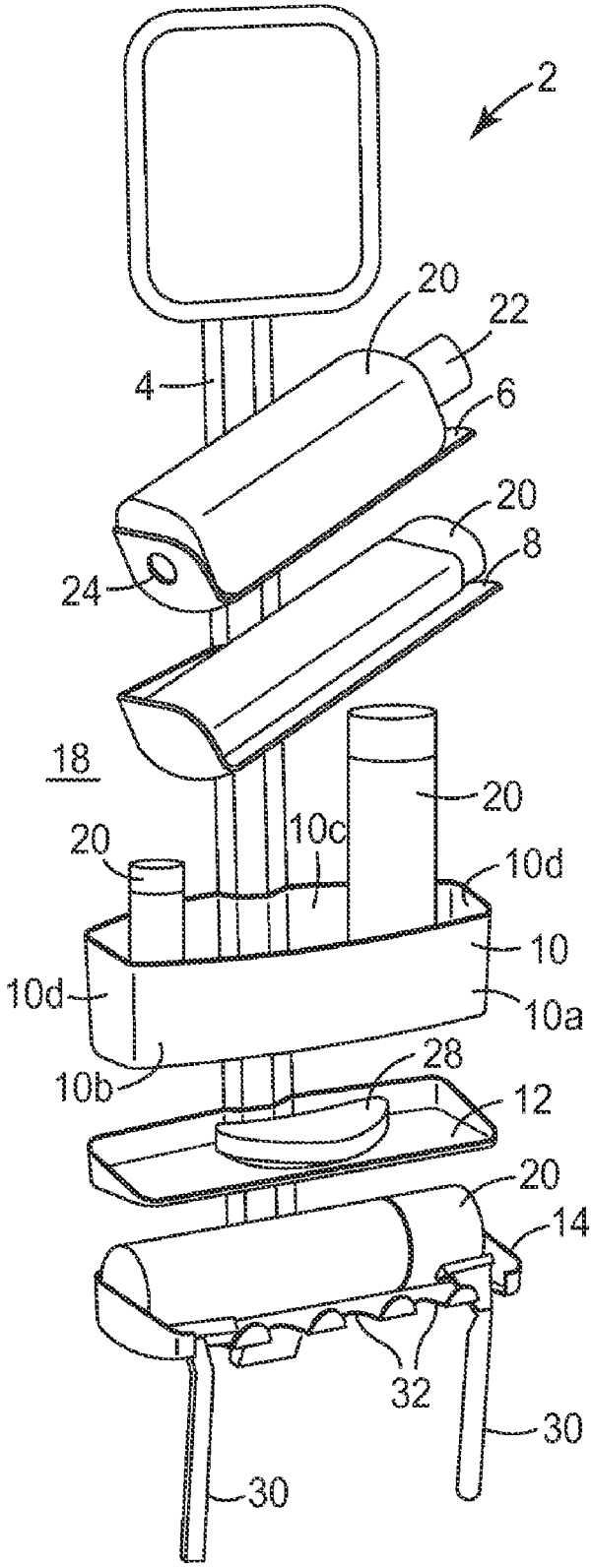
FIG. 1 is a perspective view of a wall mountable shelf assembly according to the invention.
Figure 2:
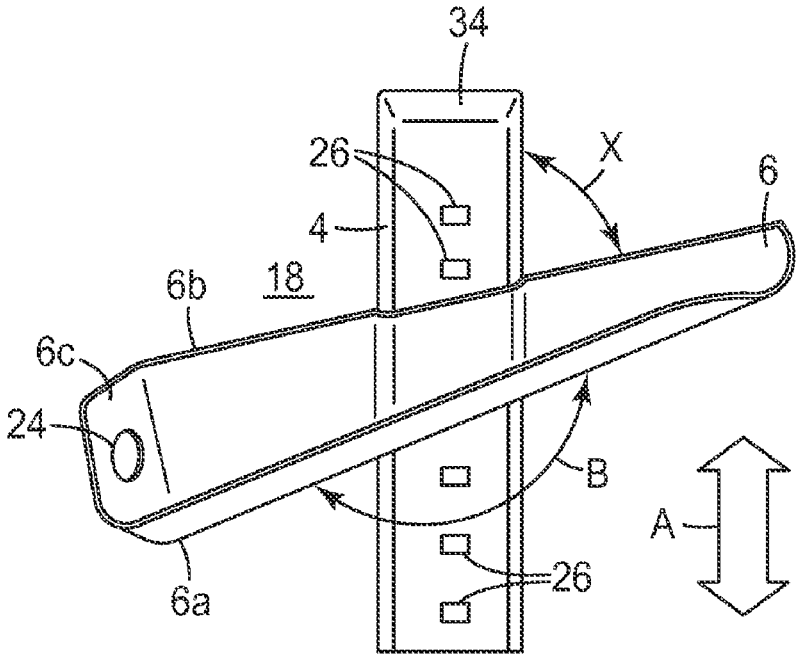
FIG. 2 is a detailed view of one accessory mounted on the support rail showing the range of movement of the accessory.
Figure 3:
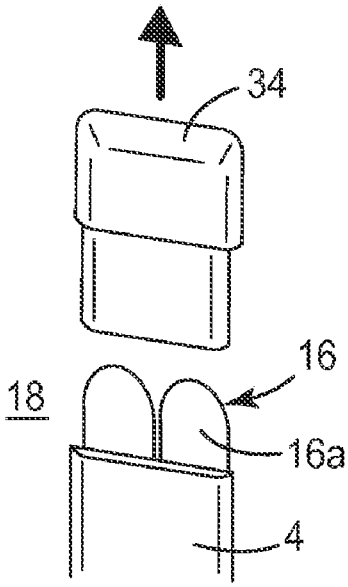
FIG. 3 is a partially exploded detailed view with the cover plate removed to reveal the non-adhesive pull tabs of a pair of stretch releasing adhesive strips.
Figure 4:
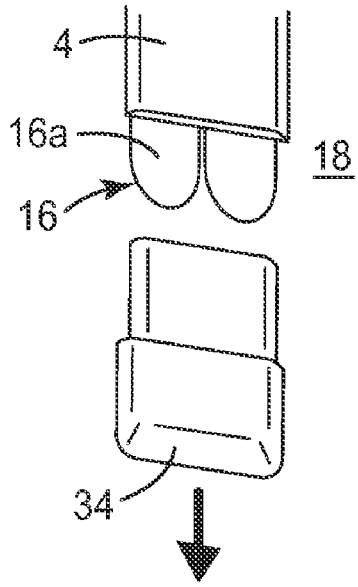
FIG. 4 is a partially exploded detailed view with a bottom cover plate removed to reveal the non-adhesive pull tabs of a pair of stretch releasing adhesive strip.

Referring now to the drawings, wherein like reference numerals refer to like or corresponding parts throughout the several views, FIGS. 1-3, show a wall mountable shelf assembly 2 for holding items such as soap, shampoo and the like in, for example, a shower or bath enclosure. The shelf assembly 2 includes an elongated support rail 4, a plurality of accessories 6,8,10,12,14 movably connected with the support rail 4, and a pair of stretch releasing adhesive strips 16 affixed to the rear surface of the support rail 4, thereby to adhesively bond the support rail 4 to a wall surface 18.

The top accessory 6 is a unitary (i.e. single piece) shelf structure configured to hold a single container 20, such as a bottle of shampoo. As shown in FIG. 2, the shelf structure 6 includes a bottom wall portion 6*a*, a back wall portion 6*b*, and a foot portion 6*c*. This "open" three-portion structure provides adequate support for the container while allowing a user to easily and quickly access the container 20. That is, the shelf structure 6 does not include a top wall or a front wall that could otherwise interfere with a user's access to the container 20. To allow a container 20 having a protruding cap 22 to be stored in an inverted position on the shelf structure 6, the foot portion 6*c* of the shelf structure 6 contains an optional opening 24 through which the container cap 22 may extend.

As depicted in FIG. 2, the position of the accessory 6 may be adjusted both translationally along the length of the support rail 4 as indicated by arrow A, or adjusted rotationally at any single location along the length of the support rail as indicated by arrow B. That is, the accessory 6 is slidable along the length of the support rail 4 and may be fixed to the support rail 4 at selected locations, and may also be rotated (i.e. pivoted sideways) to allow the angle of the accessory 6 to be adjusted relative to the support rail 4. In the illustrated embodiment, the shelf structure 6 is arranged at an angle x, as measured between the support rail 4 and the shelf structure 6, of generally no greater than about 90°. Arranged in this manner, the container 20 will rest securely in the shelf structure 6 and will not tend to tip over or slide out of the shelf structure 6.

The particular connection mechanism selected to allow the position of the shelf structure 6 to be translationally and rotationally adjusted is not significant to the invention hereof, so long as it provides the function of allowing the position of the accessory 6 to be adjusted in the manner described. For example, to allow the accessory 6 to be moved along the length of the support rail 4 and fixed at a desired location, the support rail 4 may contain a plurality of projections 26, and the accessory 6 may contain one or more slots (not shown) that mate with the projections 26, thereby to lock the accessory 6 in place. And to allow the accessory 6 to be rotated, the accessory 6 may include a spring loaded mechanism that can be released by pushing or pulling on the accessory 6 in the direction of the wall surface 18, and locks into place when the pushing or pulling force is released. Such mechanisms are generally known and are therefore not described in further detail. Thus, it will be understood that the support rail is depicted with projections 26 intending that the generic representation be illustrative of many adjustable clamping and locking mechanisms having the desired functionality which could alternatively be used. In addition, although the adjustable connection has been described only with respect to the support rail 4 and accessory 6, it will be understood that the remaining accessories 8,10,12,14 may also be provided with rotationally and/or translationally adjustable connections such as those described with respect to accessory 6.

In the illustrated embodiment, accessory 10 is a horizontally arranged unitary basket or caddy configured to hold a plurality of containers 20. The caddy 10 includes a bottom wall portion 10*a*, a front wall portion 10*b*, a rear wall portion 10*c*, and a pair of opposed side wall portions 10*d*, which together define a closed storage area. Accessory 12 is a unitary tray configured to hold a bar of soap 28. And accessory 14 is a unitary tray configured to hold a bottle of liquid 20, which is illustrated as lying on its side, and one or more conventional razors 30. To allow the tray 14 to hold the razors 30, the front wall of the tray 14 includes recessed regions 32 configured to hold such a razor.

As shown in FIG. 3, stretch releasing adhesive strips 16 are arranged between the support rail 4 and the wall surface 18, and thereby adhesively bond the shelf assembly 2 to the wall surface 18. A suitable stretch releasing adhesive is the double-sided stretch releasable adhesive strips available from 3M Company, St. Paul, Minn. under the COMMAND trade designation. Commercially available COMMAND adhesive strips are currently manufactured as discrete strips with one end of the strip including a non-adhesive pull tab to facilitate stretching of the strip during removal.

Stretch releasing adhesives are high performance pressure-sensitive adhesives that combine strong holding power with clean removal and no surface damage. The double-sided adhesive strips 16 may be any conventionally known stretch releasing adhesive tape including a stretch releasing adhesive tape with an elastic backing, a stretch releasing adhesive tape with a highly extensible and substantially inelastic backing, or a stretch releasing adhesive tape comprising a solid elastic pressure sensitive adhesive, but are preferably stretch releasable adhesive strips that are moisture resistant (i.e. they maintain their holding power in the presence of water and/or in high humidity environments).

Specific tapes suitable for use in the various embodiments of the present invention include the pressure sensitive adhesive tapes with elastic backings described in U.S. Pat. No. 4,024,312 (Korpman), the pressure sensitive adhesive tapes with highly extensible and substantially inelastic backings described in U.S. Pat. Nos. 5,516,581 (Kreckel et al.) and 6,231,962 (Bries et al.), 6,569,521 (Sheridan et al.), 7,078,093 (Sheridan et al.), and the solid elastic pressure sensitive adhesive described in German Patent No. 33 31 016. Other suitable stretch releasing adhesive constructions include the stretch removable adhesive tape laminate including a separable fastener described in U.S. Pat. No. 6,972,141 (Bries et al.), and the elongate stretch removable tape constructions described in U.S. Pat. Nos. 6,641,910 (Bries et al.), and 6,541,089 (Hamerski et al.).

The stretch releasing adhesive strips 16 include an adhesive portion, which in the FIGS is concealed by the support rail 4, and a non-adhesive pull tab portion 16*a* that extends outwardly beyond the top of the support rail 4 as shown in FIG. 3. In the illustrated embodiment, the shelf assembly 2 includes an optional cover plate 34 that connects with the top end of the support rail 4. When the cover plate 34 is connected with the support rail 4, it serves to conceal the non-adhesive pull tab portions 16*a* of the stretch releasing adhesive strips 16, but, when removed from the support rail 4, the non-adhesive pull tabs 16*a* are visible and may be readily accessed by a user wishing to stretch remove the adhesive strips 16 from the wall surface 18.

Although the stretch releasing adhesive strips 16 and cover plate 34 have been described as being provided at the top of the self assembly 2, the shelf assembly 2 may also include stretch releasing adhesive strips arranged to adhesively bond the bottom of the support rail 4 to the wall surface 18, and another cover plate may be arranged on the bottom of the support rail 4 to selectively conceal the non-adhesive pull tab portions of the stretch releasing adhesive strips extending beyond the bottom of the support rail 4.

In addition, in the case where the adhesive strips 16 include a separable fastener, such as is described in U.S. Pat. No. 6,972,141 (Bries et al.), the adhesive strips 16 may be arranged such that both the adhesive portion 16*a* and the non-adhesive pull tab portion 16*b* of the adhesive strip are concealed by the support rail. This is possible because the adhesive strips can be removed by first separating each adhesive strip via the separable fastener and then stretch removing each remaining half of each adhesive strip from its respective surface. In this case, the cover plate 34 may be omitted.

The shelf assembly 2, including both the support rail 4 and the accessories, 6,8,10,12,14 may formed of any suitable material including metals and synthetic plastic materials. In one embodiment, the support rail 4 and the accessories, 6,8,10,12,14 are formed from an injected molded synthetic plastic material. The support rail 4 may also be an extruded metal or synthetic plastic material.

Persons of ordinary skill in the art may appreciate that various changes and modifications may be made to the invention described above without deviating from the inventive concept. For example, it will be recognized that although the shelf assembly 2 is illustrated as being mounted with two adhesive strips, one or more such strips may be used. In addition, different accessories, such as a mirror, may be provided. Thus, the scope of the present invention should not be limited to the structures described in this application, but only by the structures described by the language of the claims and the equivalents of those structures.

What is claimed is:

1. A vertically mounted shelf assembly, comprising:

(a) an elongated support rail;

(b) at least one accessory movably connected with the support rail; and (c) at least one stretch releasing adhesive strip arranged between the support rail and a wall for securing the shelf assembly to the wall; wherein the stretch releasing adhesive strip is a double-sided adhesive strip including a non-adhesive pull tab at one end, and when the support rail is mounted vertically on a wall surface, the non-adhesive pull tab extends outwardly beyond the top of the support rail; and further comprising a cover plate removably connected with the top of the support rail, whereby when the cover plate is connected with the support rail, the cover plate conceals the non-adhesive pull tab portion of the stretch releasing adhesive strip.

2. A shelf assembly as defined in claim 1, wherein the accessory is rotatably connected with the support rail such that the accessory is rotatable in a plane parallel with a front face of the support rail.

3. A shelf assembly as defined in claim 1, wherein the accessory is a unitary shelf structure configured to hold a single container of liquid, the shelf structure including a bottom wall portion, a back wall portion, and a foot portion.

4. A shelf assembly as defined in claim 3, wherein the foot portion of the shelf structure contains an opening sized to receive a cap of the single container of liquid.

5. A shelf assembly as defined in claim 3, wherein the bottom wall portion defines a first end at an intersection with the foot portion and a second end opposite the first end, and further wherein when the support rail is vertically oriented, the bottom wall portion is arranged at an angle with respect to the support rail in which the second end is spatially above the first end.

6. A shelf assembly as defined in claim 1, wherein the accessory is a caddy configured to hold a plurality of containers, the caddy including a bottom wall portion, a front wall portion, a rear wall portion, and a pair of opposed side wall portions.

7. A shelf assembly as defined in claim 1, wherein the accessory is a tray configured to hold a bar of soap.

8. A shelf assembly as defined in claim 1, wherein the accessory is a tray configured to hold a single bottle of liquid and the tray has a front wall including recessed regions configured to hold a conventional razor.

9. A shelf assembly as defined in claim 1, further comprising a second stretch releasing adhesive strip including a non-adhesive pull tab at one end and arranged between a bottom of the support rail and the wall surface, wherein the non-adhesive pull tab portion of the second stretch releasing adhesive strip extends outwardly below the bottom of the support rail.

10. A shelf assembly as defined in claim 9, further comprising a second cover plate removably connected with the bottom of the support rail, whereby when the second cover plate is connected with the support rail, the second cover plate conceals the non-adhesive pull tab portion of the second stretch releasing adhesive strip.

11. A shelf assembly as defined in claim 1, wherein the support rail and accessory are formed of an injected molded synthetic plastic material.

12. A shelf assembly as defined in claim 1, wherein at least one accessory includes:

a first accessory provided as a unitary shelf structure configured to hold a single container of a liquid;

a second accessory provided as a caddy configured to hold a plurality of containers; and a third accessory provided as a tray configured to hold a bar of soap;

wherein the first, second, and third accessories differ from one another in terms of shape and size.

13. A shelf assembly as defined in claim 1, wherein the stretch releasing adhesive strip includes an adhesive surface directly in contact with the support rail.

14. A shelf assembly as defined in claim 1, wherein the stretch releasing adhesive strip is moisture resistant such that the stretch releasing adhesive strip maintains a holding power in the presence of water.

* * * * *